US006729379B1

(12) United States Patent
Nien

(10) Patent No.: US 6,729,379 B1
(45) Date of Patent: May 4, 2004

(54) FABRIC BLIND ASSEMBLY

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/378,874

(22) Filed: Mar. 5, 2003

(30) Foreign Application Priority Data

Dec. 2, 2002 (TW) ..... 91219745 U

(51) Int. Cl.[7] ..... E06B 9/08
(52) U.S. Cl. ..... 160/121.1; 160/84.05
(58) Field of Search ..... 160/121.1, 84.05, 160/89, 84.04, 120, 170 R, 176.1 R, 133

(56) References Cited

U.S. PATENT DOCUMENTS 2,267,869 A * 12/1941 Loehr ..... 160/89
2,914,122 A * 11/1959 Pinto
2,994,370 A * 8/1961 Pinto ..... 160/89
4,928,369 A * 5/1990 Schnebly et al. ..... 29/24.5
4,984,617 A * 1/1991 Corey ..... 160/84.02
5,490,553 A * 2/1996 Colson et al. ..... 160/84.06
5,664,613 A * 9/1997 Jelic ..... 160/84.05
5,845,690 A * 12/1998 Colson et al. ..... 160/84.01
6,550,519 B2 * 4/2003 Green et al. ..... 160/84.04

* cited by examiner

*Primary Examiner*—David Purol
(74) *Attorney, Agent, or Firm*—Bacon & Thomas, PLLC

(57) ABSTRACT

A fabric blind assembly is constructed to include a receiving member, a bottom rail suspended below the receiving member, fabric blind slats arranged in parallel between the receiving member and the bottom rail, two braided ladders connected between the receiving member and the bottom rail at one side and coupled to one long side of each fabric blind slat to hold the fabric blind slats in parallel between the receiving member and the bottom rail, a connecting device connected between the receiving member and the bottom rail at one side opposite to the braided ladders and fastened to the other long side of each fabric blind slat, and a curtain detachably connected between the receiving member and the bottom rail outside the fabric blind slats.

8 Claims, 4 Drawing Sheets

FABRIC BLIND ASSEMBLY

BACKGROUND OF THE INVENTION

1. Field of the Invention

The present invention relates generally to blinds and, more particularly, to a fabric blind assembly.

2. Description of the Related Art

A conventional fabric blind assembly generally comprises a barrel, a bottom rail suspended below the barrel, two curtains between the barrel and the bottom rail at two sides, and a number of light-tight blind slats arranged in parallel between the barrel and the bottom rail and respectively fixedly fastened to the curtains in different elevations. The relative displacement between the curtains controls the tilting angle of the blind slats to regulate the amount of light passing through gaps in between the slats. The soft touch of the curtains attracts consumers.

According to the aforesaid fabric blind assembly, the blind slats are fixedly fastened to the curtains by hot pressing, high-frequency heat sealing, or stitching (see U.S. Pat. Nos. 5,419,385; 6,164,363). This design of fabric blind assembly has drawbacks. The bonding traces in the connecting areas between the curtains and the blind slats destroy the sense of beauty of the fabric blind assembly. Furthermore, because the blind slats are not detachable, it is difficult to clean the blind slats and the inner sides of the curtains.

SUMMARY OF THE INVENTION

It is the main object of the present invention to provide a fabric blind assembly, which shows no connection traces between the curtain and the blind slats.

It is another object of the present invention to provide a fabric blind assembly, which enables the user to detach the blind slats from the curtain for cleaning.

To achieve these objects of the present invention, the fabric blind assembly comprises a receiving member, a bottom rail suspended below the receiving member, fabric blind slats arranged in parallel between the receiving member and the bottom rail, two braided ladders connected between the receiving member and the bottom rail at one side and coupled to one long side of each fabric blind slat to hold the fabric blind slats in parallel between the receiving member and the bottom rail at different elevations, a connecting device connected between the receiving member and the bottom rail at one side opposite to the braided ladders and fastened to the other long side of each fabric blind slat to hold the fabric blind slats in parallel between the receiving member and the bottom rail, and a curtain detachably connected between the receiving member and the bottom rail outside the slats.

DETAILED DESCRIPTION OF THE INVENTION

Figure 1:
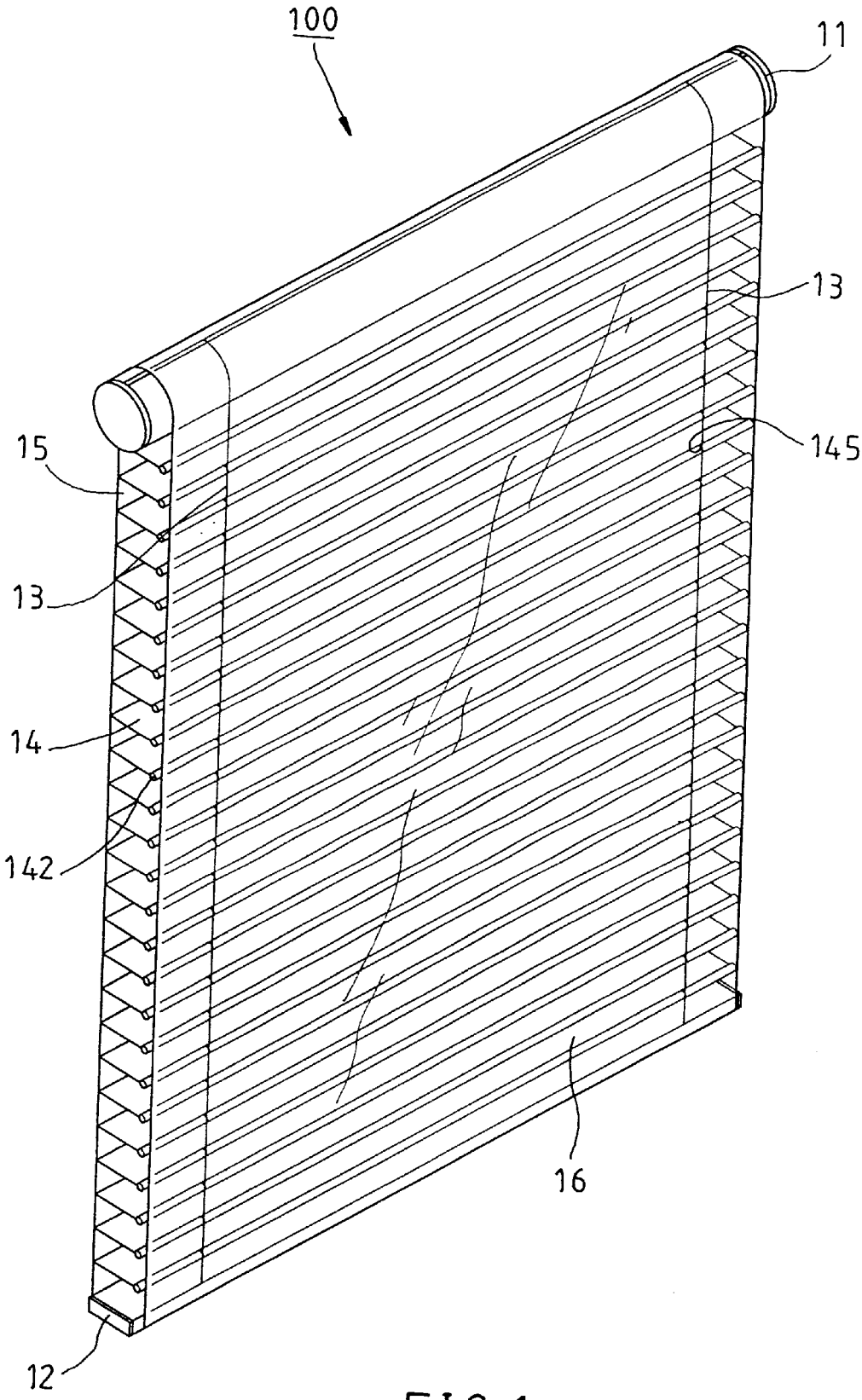
FIG. 1 is a perspective view of a fabric blind assembly according to a first preferred embodiment of the present invention.
Figure 2:
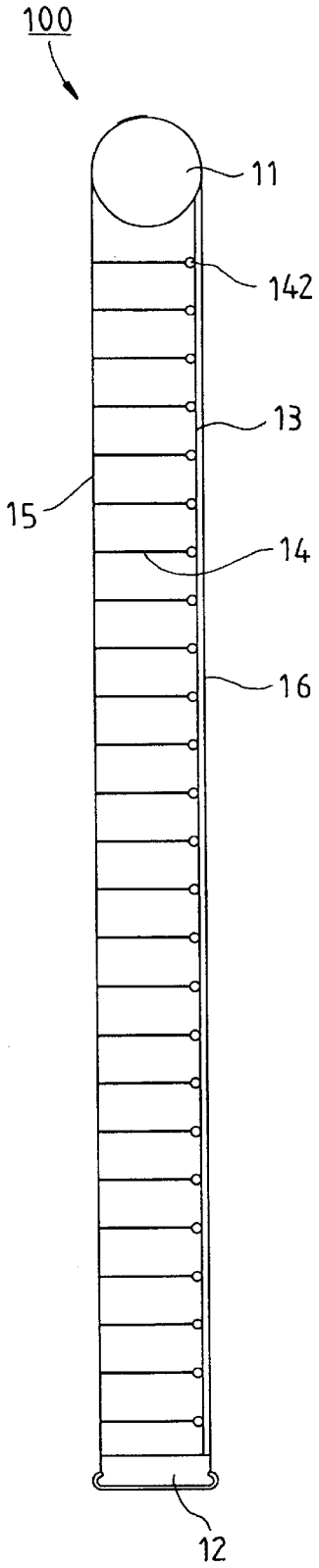
FIG. 2 is a side view of the fabric blind assembly according to the first embodiment of the present invention.
Figure 3:
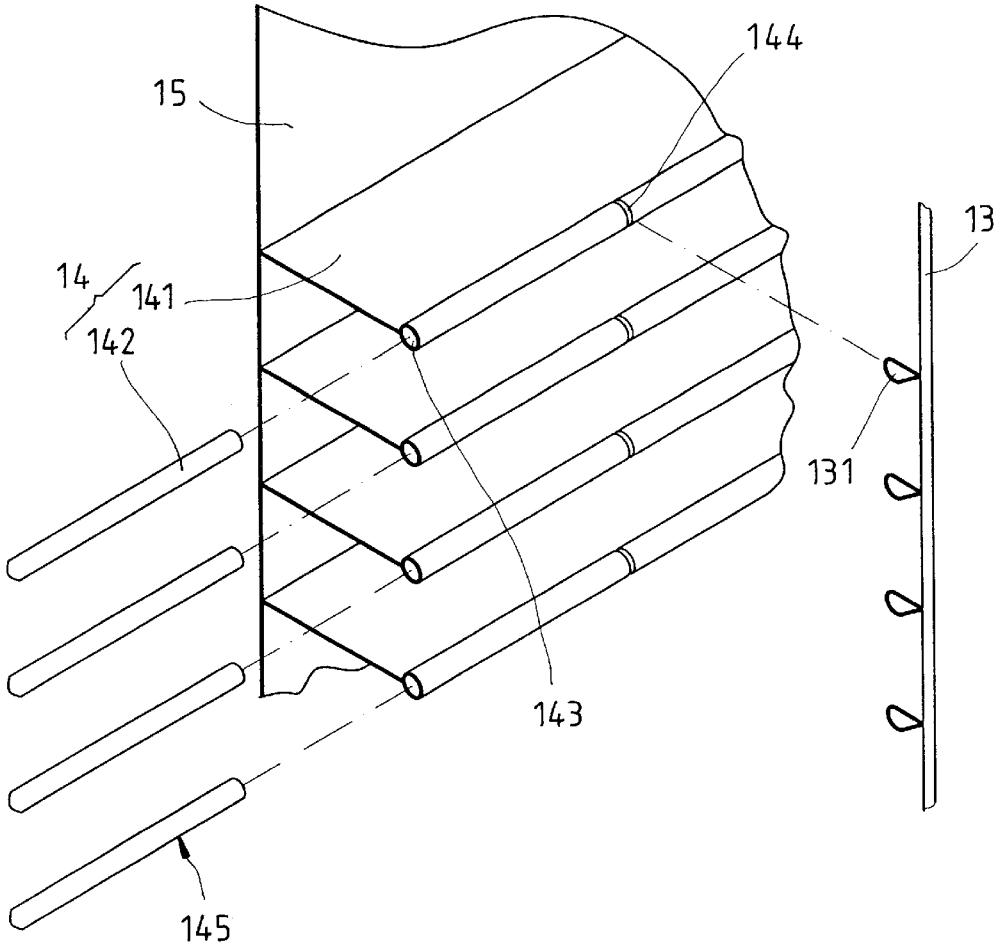
FIG. 3 is an exploded view of a part of the fabric blind assembly according to the first embodiment of the present invention.

Referring to FIGS. 1~3, a fabric blind assembly 100 in accordance with the first preferred embodiment of the present invention is shown comprised of a receiving member 11 formed of a barrel and transversely pivoted to the top side of the window (not shown), a bottom rail 12 extended in transverse direction and suspended below the receiving member 11, a number of fabric blind slats 14 arranged in parallel between the receiving member 11 and the bottom rail 12, two braided ladders 13 longitudinally bilaterally connected between the receiving member 11 and the bottom rail 12 to join the fabric blind slats 14 and to hold the fabric blind slats 14 in parallel, a connecting device 15, and a curtain 16.

The braided ladders 13 are vertically bilaterally connected between the receiving member 11 and the bottom rail 12, each having a plurality of equally vertically spaced retaining members 131 corresponding to the fabric blind slats 14. The retaining members 131 according to this embodiment are loops tied to the braided ladders 13.

Each fabric blind slat 14 is comprised of an elongated strip of fabric 141 and one rod member 142. The strip of fabric 141 is a piece of opaque or semitransparent fabric capable of protecting from light, having a pocket 143 longitudinally extended along one long side thereof The pocket 143 can be formed of a part of the strip of fabric 141 by stitching or bonding, having transversely extended crevices 144. The rod member 142 is a rigid member having an outer diameter smaller than the inner diameter of the pocket 143. The length of the rod member 142 is approximately equal to the longitudinal depth of the pocket 143. When inserted into the pocket 143, the rod member 142 can be rotated in the pocket 143. Further, the rod member 142 has a plurality of coupling portions 145 corresponding to the crevices 144. During installation, the retaining members 131 of the braided ladders 13 are respectively inserted into the crevices 144, and then the rod members 142 of the blind slats 14 are respectively inserted into the pockets 143 of the strips of fabric 141 and the retaining members 131 of the braided ladders 13, keeping the blind slats 14 secured to the braided ladders 13 at different elevations.

The connecting member 15 is a sheet of fabric, having a top side fixedly fastened to the receiving member 11 and a bottom side fixedly fastened to the bottom rail 12. One face, namely, the inner face of the connecting device 15 is bonded to the other long side of each of the blind slats 14, i.e., the blind slats 14 each have one long side bonded to the connecting device 15 and the other long side coupled to the retaining members 131 of the braided ladders 13.

The curtain 16 can be a transparent or semitransparent sheet of fabric. The area of the curtain 16 is equal to the area of the fully extended status of the fabric blind assembly 100. The width of the curtain 16 is approximately equal to the length of the blind slats 14. The top and bottom sides of the curtain 16 are respectively fastened to the receiving member 11 and the bottom rail 12 by hook and loop materials. When installed, the curtain 16 is suspended outside the braided ladders 13, i.e., the braided ladders 13 are maintained between the curtain 16 and the blind slats 14.

As indicated above, the curtain 16 is directly connected between the receiving member 11 and the bottom rail 12 without direct connection to the blind slats 14. Because the curtain 16 is not fastened to the blind slats 14, it is maintained smooth. Further, because the curtain 16 is fastened to the receiving member 11 and the bottom rail 12 by hook and loop materials, it is detachable for easy cleaning. The user can replace the curtain 16 with a different design. Because the blind slats 14 are not fixedly fastened to the braided ladders 13, the user can detach the blind slats 14 from the braided ladders 13 and the curtain 16 for cleaning.

Further, the pitch among the retaining members 131 of the braided ladders 13 is approximately equal to the length of the short sides of the blind slats 14. When wishing to enhance the light shading effect of the fabric blind assembly 100, the user can rotate the receiving member 11 through a predetermined angle to move the two opposite long sides of each fabric blind slat 14 toward the top and bottom sides in reversed directions, changing the fabric blind slats 14 from the horizontal position to about a vertical position to close the gaps in between the fabric blind slats 14. Because the rod members 142 can be rotated relative to the retaining members 131 of the braided ladders 13, rotating the receiving member 11 to tilt the fabric blind slats 14 causes the retaining members 131 to be turned relative to the rod members 142, preventing uneven tension between the braided ladders 13 and the fabric blind slats 14.

Figure 4:
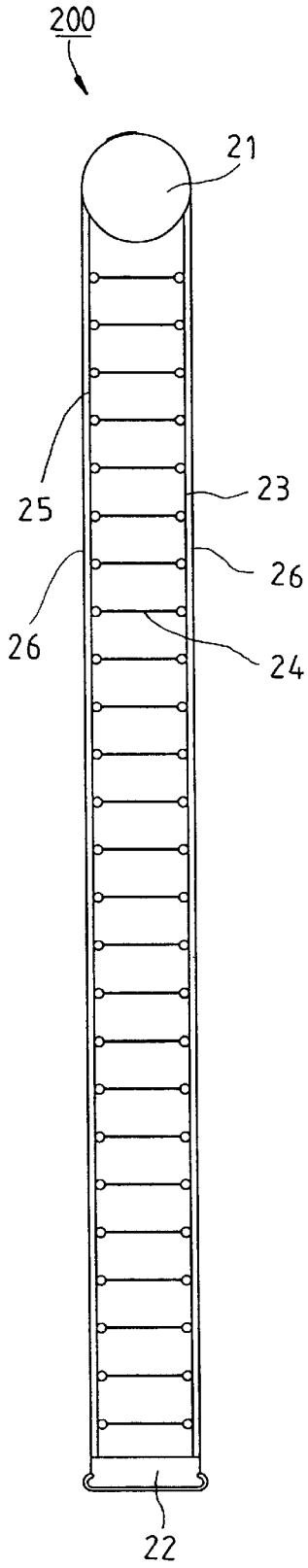
FIG. 4 is a side view of a fabric blind assembly according to a second preferred embodiment of the present invention.
Figure 5:
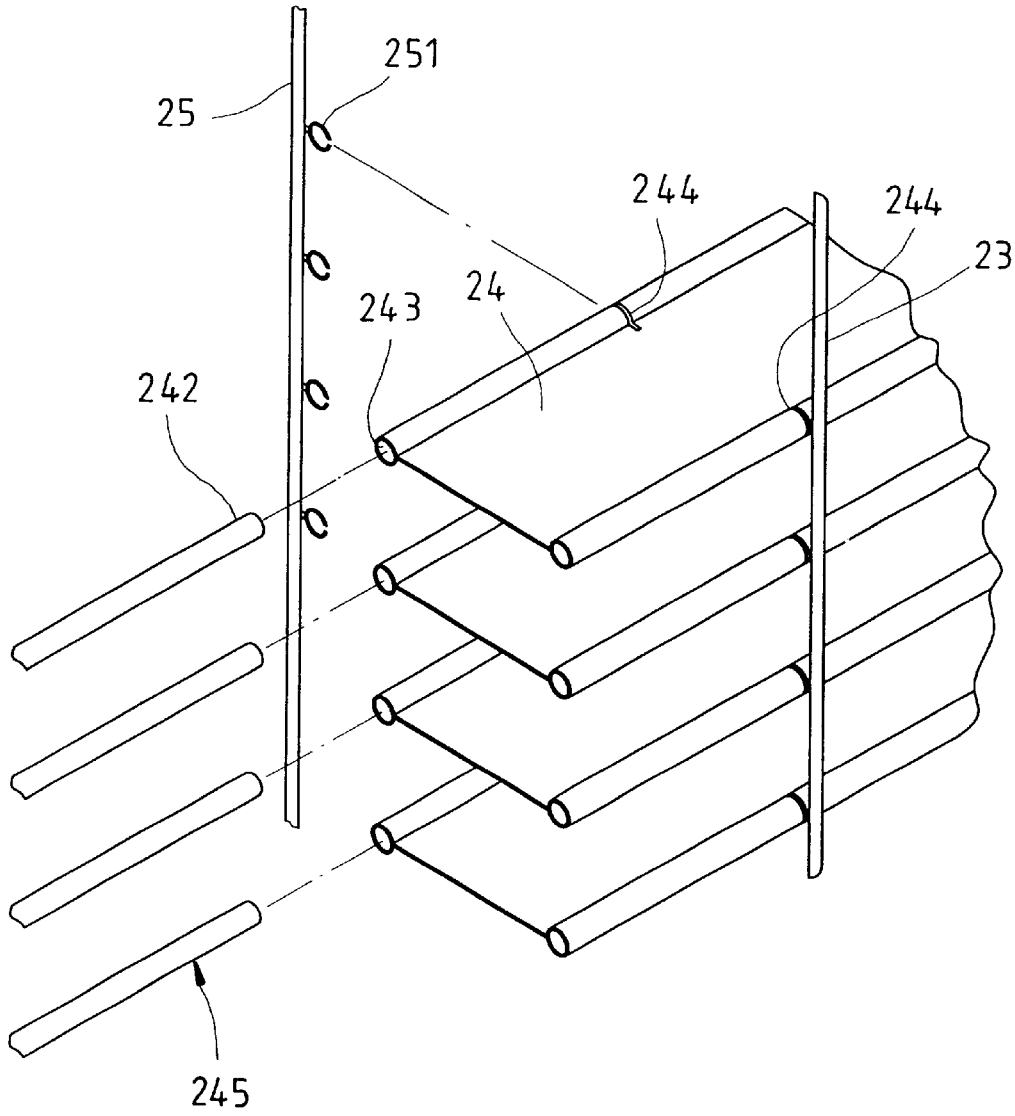
FIG. 5 is an exploded view of a part of the fabric blind assembly according to the second embodiment of the present invention.

FIGS. 4 and 5 show a fabric blind assembly 200 constructed according to the second preferred embodiment of the present invention. According to this embodiment, the fabric blind assembly 200 is comprised of a receiving member 21, a bottom rail 22, two braided ladders 23, and a number of fabric blind slats 24, a connecting member 25, and two curtains 26. According to this embodiment, the retaining members 231 of the braided ladders 23 are C-shaped clamps of tough and springy material. The connecting device 25 is comprised of two braided ladders each having a plurality of vertically spaced retaining members 251 corresponding to the retaining members 231 of the braided ladders 23. Each fabric blind slat 24 has two pockets 243 longitudinally extended along two opposite long sides thereof, each pocket 243 having two transversely extended crevices 244, and two rod members 242 respectively inserted into the pockets 243. The rod members 242 are rigid members insertable into the pockets 243. The rod members 142 each have at least one coupling portion 245. After insertion of the rod members 242 into the pockets 243, the retaining members 231 of the braided ladders 23 and the retaining members 251 of the connecting device 25 are respectively inserted into the crevices 244 of the pockets 243 of the fabric blind slats 24 and fastened to the coupling portions 245 of the rod members 242. Further, the curtains 26 are detachably fastened to the receiving member 11 and the bottom rail 12 by hook and loop materials and vertically suspended at two sides of the blind slats 14. When viewed either from the inside of the window or the outside of the window, the curtains 26 show a smooth sense of beauty.

Although particular embodiments of the invention have been described in detail for purposes of illustration, various modifications and enhancements may be made without departing from the spirit and scope of the invention. For example, clamping or any of a variety of detachable fastening measures may be adopted to secure the curtain(s) to the receiving member and the bottom rail. Accordingly, the invention is not to be limited except as by the appended claims.

What is claimed is:

1. A fabric blind assembly comprising:

a receiving member;

a bottom rail suspended below said receiving member;

plurality of fabric blind slats arranged in parallel between said receiving member and said bottom rail, said fabric blind slats each having a first long side and a second long side;

two braided ladders connected between said receiving member and said bottom rail at one side and coupled to the first long side of each of said fabric blind slats to hold said fabric blind slats in parallel between said receiving member and said bottom rail, a connecting device connected between said receiving member and said bottom rail at one side opposite to said braided ladders and fastened to the second long side of each of said fabric blind slats to hold said fabric blind slats in parallel between said receiving member and said bottom rail; and a curtain having a transverse width substantially equal to the length of said fabric blind slats and connected between said receiving member and said bottom rail outside said fabric blind slats.

2. The fabric blind assembly as claimed in claim 1, wherein said receiving member is a barrel rotatable to roll up said braided ladders.

3. The fabric blind assembly as claimed in claim 1, wherein said braided ladders each have a plurality of vertically spaced retaining members respectively formed of a loop; said fabric blind slats each comprise a pocket extended along the first long side, said pocket having two crevices, which receive one retaining member of each of said braided ladders respectively, and a rod member inserted into said pocket and fastened to the respective retaining members of said braided ladders in the crevices of the respective pocket.

4. The fabric blind assembly as claimed in claim 1, wherein said braided ladders each have a plurality of vertically spaced retaining members respectively formed of a tough and springy C-shaped clamps; said fabric blind slats each comprise a pocket extended along the first long side, said pocket having two crevices, which receive one retaining member of each of said braided ladders respectively, and a rod member inserted into said pocket and fastened to the respective retaining members of said braided ladders in the crevices of the respective pocket.

5. The fabric blind assembly as claimed in claim 1, wherein said connecting device is comprised of two braided ladders connected between said receiving member and said bottom rail and fastened to the second long side of each of said fabric blind slats.

6. The fabric blind assembly as claimed in claim 1, wherein said at least one curtain is respectively fastened to said receiving member and said bottom rail by hook and loop materials.

7. The fabric blind assembly as claimed in claim 1, wherein said at least one curtain is respectively fastened to said receiving member and said bottom rail by clamp means.

8. The fabric blind assembly as claimed in claim 1, wherein said curtain is disposed outside said braided ladders.

* * * * *